United States Patent [19]

Keller

[11] Patent Number: 4,778,069

[45] Date of Patent: Oct. 18, 1988

[54] TAMPER INDICATING PACKAGE

[75] Inventor: Robert G. Keller, Mountainside, N.J.

[73] Assignee: CPC International Inc., Englewood Cliffs, N.J.

[21] Appl. No.: 117,022

[22] Filed: Nov. 4, 1987

Related U.S. Application Data

[63] Continuation of Ser. No. 38,574, Apr. 15, 1987, abandoned.

[51] Int. Cl.[4] ..... B65D 51/18

[52] U.S. Cl. ..... 215/232; 215/250

[58] Field of Search ..... 215/232, 250, 218, 220, 215/225; 220/258, 277

[56] References Cited

U.S. PATENT DOCUMENTS

| | | | |
|---|---|---|---|
| 4,519,514 | 5/1985 | Agbay et al. | 215/220 X |
| 4,527,702 | 7/1985 | Heath, Jr. | 215/225 |
| 4,534,477 | 8/1985 | Laub, III | 215/250 X |
| 4,540,098 | 9/1985 | Luker | 215/216 |
| 4,598,837 | 7/1986 | Kreiseder et al. | 220/258 X |
| 4,694,971 | 9/1987 | Elsmo et al. | 215/253 |

*Primary Examiner*—Stephen Marcus
*Assistant Examiner*—Nova Stucker

[57] ABSTRACT

The tamper indicating package includes a receptacle, such as a jar having a cover member threaded thereon. The mouth of the jar is sealed beneath the cover member with a seal member. The cover member has a depending flange with a slot that accommodates a tab indicating member joined to the seal member of formed integrally with the seal member. Rotation of the cover member from a predetermined closed limit position causes the slot in the cover member to interfere with the tab indicating member. The interference causes partial or complete severance of the tab indicating member from the seal member, providing a visible indication of previous tampering with the package.

22 Claims, 3 Drawing Sheets

TAMPER INDICATING PACKAGE

This is a continuation of application Ser. No. 038,574, filed Apr. 15, 1987, now abandoned.

BACKGROUND OF THE INVENTION

This invention relates to tamper indicating packages, and more particularly to an external tampering indicator on the seal member of a package.

The term "tamper" as used herein is intended to refer to the opening of a closed or sealed package before it has been purchased. The term "open" as used herein is intended to refer to a partial or full opening of a package.

In certain instances articles purchased by consumers in closed or otherwise sealed containers are tampered with beforehand by individuals having motives that range from petty vandalism to harmful maliciousness. The problem of tampering has led to enactment of a Federal law which makes it a felony to tamper with merchandise with the intent to harm people.

Many packages which appear to be closed or sealed can be opened and closed without detection. For example, packages that have no seals or bonds can be easily opened and closed without a visible indication of such opening. Furthermore, the contents of such packages might be altered in a manner which is not obvious or detectable by the purchaser. The average purchaser is accustomed to believe in the integrity of a closed or sealed package and can thus be victimized by acts of tampering.

Although tampering is an aberrant practice that affects a relatively small percentage of purchased articles, it has become necessary to deal with this problem at the manufacturing level in order to maintain consumer confidence in the integrity of a closed or sealed package.

Various known means of providing a package with tamper resistant characteristics include shrink bands and breakable caps. The application of outer shrink bands or tape requires a substantial capital investment and ongoing material costs. Breakable caps are more feasible on containers with relatively small-mouth openings rather than those with wide-mouth openings. However, specially designed molds and tools for the manufacture of breakable caps add significantly to the cost of the goods packaged in containers with breakable caps.

Some packages having an opening of fixed size include inner seals that, for example, extend across the mouth of a jar, underneath a cover. When the cover is removed, the seal must be broken to obtain access to the package contents. Unfortunately, seals can also be tampered with and packages having such seals often do not provide external evidence that the package cover has been removed.

When an act of tampering is detectable because an article shows signs of tampering, the consumer's attention will be signaled. The consumer then has the option of not purchasing the article. In addition, a retailer can be put on notice that an article has been tampered with and remove such article from his sellable stock.

In addition to the provision of tamper-resistant features in packages which alert a consumer to possible wrongdoing, there is ongoing publicity that encourages consumers to check the integrity of packages before purchasing them. As a result, future tampering is likely to be discouraged if it is apparent that such tampering can be detected.

Other alternative packaging arrangements which have been developed to provide an indication of whether tampering has occurred include a cover system as shown in U.S. Pat. No. 4,446,979, which displays a readout to indicate when a cover has been opened from its sealed position. U.S. Pat. No. 4,519,514 shows a tamper-indicating flap molded to the neck of a container. The flap is fractured from the neck after the cap is placed in an open condition.

Devices such as those shown in the foregoing patents require expensive and exotic manufacturing equipment which can substantially increase the cost of the goods that are sold in the packages.

It is thus desirable to provide a tamper indicating package which does not substantially increase the cost of the goods being sold in the package and which readily shows whether the package has been subjected to tampering.

OBJECTS AND SUMMARY OF THE INVENTION

Among the several objects of the invention may be noted the provision of a novel tamper indicating package, a novel tamper indicating package which is easy to assemble and use, a novel tamper indicating package that provides an immediate and obvious indication of any instances of tampering, a novel tamper indicating package that is economical to construct and simple to operate, and a novel method of indicating that a package has been tampered with.

Other objects and features of the invention will be in part apparent and in part pointed out hereinafter.

The tamper indicating package, in accordance with one embodiment of the invention, includes a receptacle having an interior space and a mouth portion that is preferably threaded to receive a cover member. A seal member is provided across the mouth portion beneath the cover member to seal the interior space of the receptacle.

A tamper indicating means includes at least one indicating tab immovably joined to the seal member to extend through at least one slot formed in the cover member when the cover member is in a predetermined closed limit position on the receptacle.

When the cover member is moved relative to the receptacle toward an open position, a severing edge of the slot interferes with the indicating tab, causing the tab to rip or sever from the seal member.

The removal or partial ripping of the indicating tab from the seal member reveals that the package has been subjected to tampering. Thus, there is a visual indication that a package has been opened.

In assembling the package indicating means, the seal member and tamper indicating tab are preferably integrally joined together and positioned in the cover member such that the tamper indicating tab projects through the slot of the cover member. The seal member and tamper indicating tab are not bonded or adhered to the cover member. The cover member, with the seal member disposed therein, is threaded to the mouth portion of the receptacle to a predetermined closed limit position wherein the seal member no longer turns with the cover member.

The seal member is then bonded or otherwise adhered to the mouth portion using induction heating or any other suitable known means for joining the seal member to the mouth portion.

Under this arrangement no significant amounts of additional package material beyond the seal member are needed to provide a tamper indicating package.

The tamper indicating package is thus economical to manufacture and provides a convenient visual indication of any package tampering.

The invention accordingly comprises the constructions and method hereinafter described, the scope of the invention being indicated in the claims.

DESCRIPTION OF THE DRAWINGS

In the accompanying drawings.

Corresponding reference characters indicate corresponding parts throughout the several views of the drawings.

DETAILED DESCRIPTION OF THE INVENTION

Figure 1:
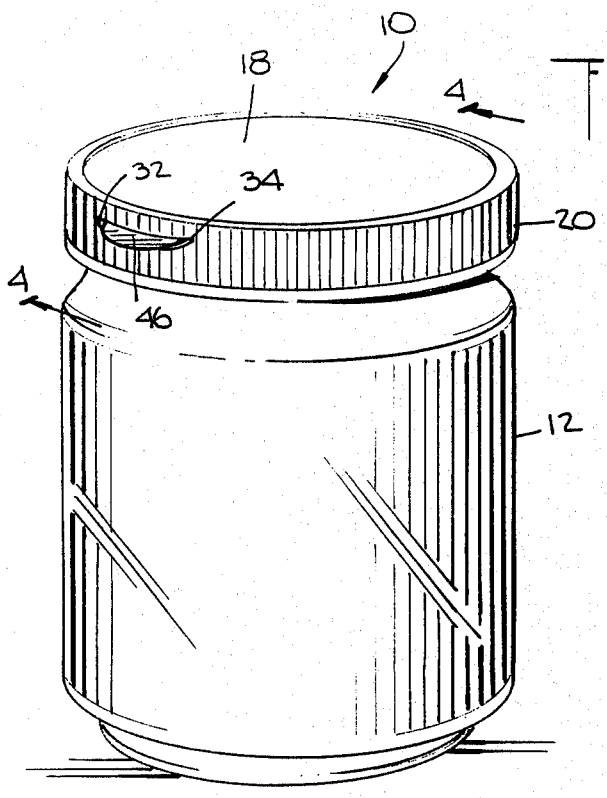
FIG. 1 is a simplified perspective view of a tamper indicating package incorporating one embodiment of the invention.

A tamper indicating package incorporating one embodiment of the invention is generally indicated by the reference number 10 in FIG. 1.

The tamper indicating package 10 comprises a jar or receptacle 12 formed of glass or other suitable known material. The contents 13 (FIGS. 4 and 5) of the receptacle 12 can be in any selected form, such as liquid, solid, solid-particulate or pasty consistency, for example.

The receptacle 12 has a mouth portion 14 at one end which is preferably formed with external threads 16.

A detachable cover member 18, formed of a suitable plastic or metal material, includes a depending annular flange 20 having internal threads 22 that are engageable with the threads 16 of the receptacle 12. The cover member 18 is rotatable about an axis 24 (FIG. 11) in a clockwise direction to a predetermined closed limit position on the mouth portion 14. Reverse rotation of the cover member 18 in a counter-clockwise direction (FIGS. 2 and 5) moves the cover member 18 toward an open position for removal from the receptacle 12.

The cover member 18 further includes at least one elongated slot 26 in the flange 20 having a predetermined radial extent with respect to the axis 24. The slot 26 includes an upper elongated radial edge 28 and a lower edge 30 that is curved toward the upper edge 28, intersecting the upper edge 28 at opposite slot ends 32 and 34. The edge 30 is tapered at 36 to form a severing surface.

Figure 9:
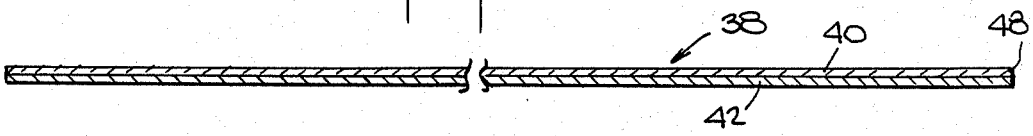
FIG. 9 is a sectional view taken on the line 9—9 of FIG. 8.
Figure 12:
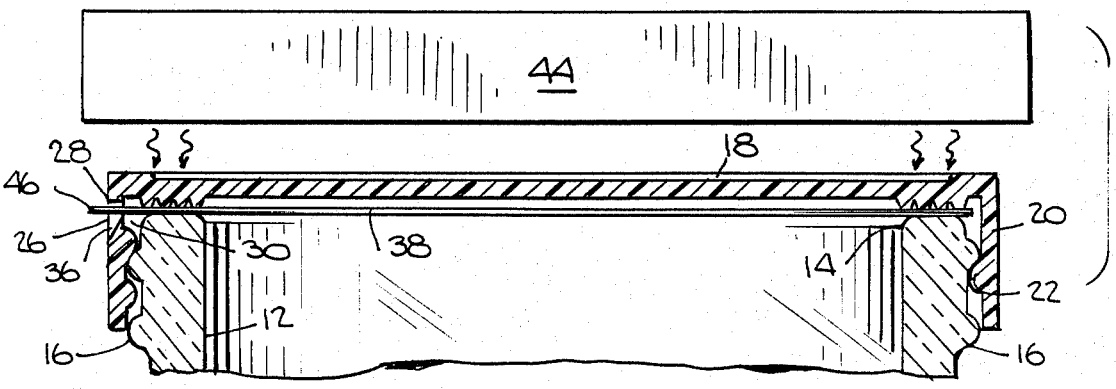

The package 10 further includes a seal or closure member 38 sized to span the mouth portion 14 of the receptacle 12. The seal member 38, which can be formed of cellulose derivatives, aluminum foil, plastic and combinations thereof, includes an impervious cover layer 40 (FIG. 9) and a heat sensitive layer 42. When the heat sensitive layer 42 is disposed against the mouth portion 14 the seal member 38 is adhered in a known manner, as for example by using an induction sealer 44 (FIG. 12).

Figure 8:
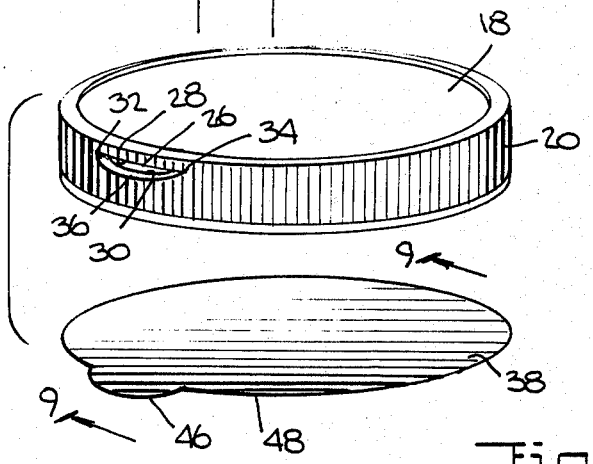
FIG. 8 is an exploded perspective view of the cover member, seal member and tamper indicating tab.
Figure 10:
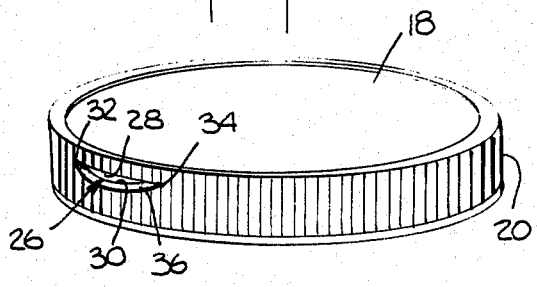
FIG. 10 is an assembly of the components of FIG. 8.

Indicating means, such as a tab 46, extend a predetermined amount from a peripheral edge 48 (FIG. 8) of the seal member 38. Those skilled in the art will recognize that a tab on said seal member represents no additional cost since it is formed from material which is normally trim waste. The tab member 46 has a predetermined extent along the peripheral edge 48.

Figure 4:
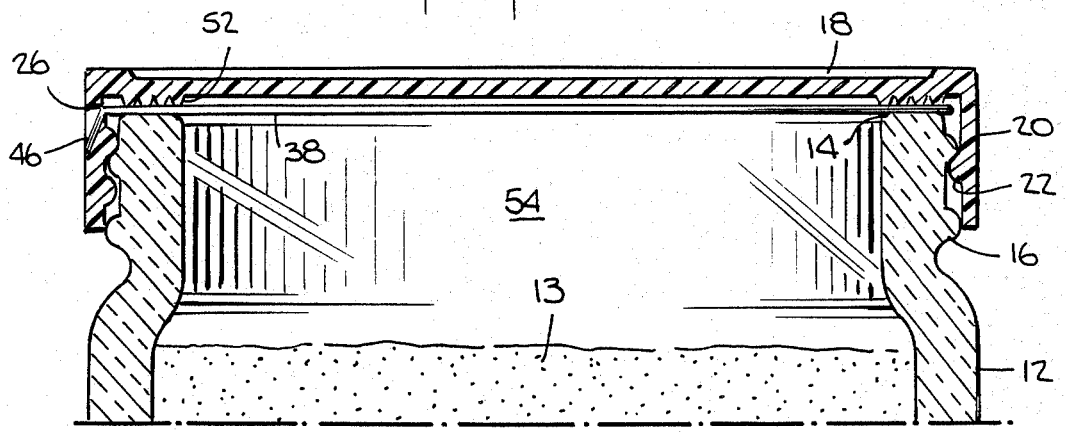
FIG. 4 is an enlarged fragmentary sectional view taken on the line 4—4 of FIG. 1.
Figure 5:
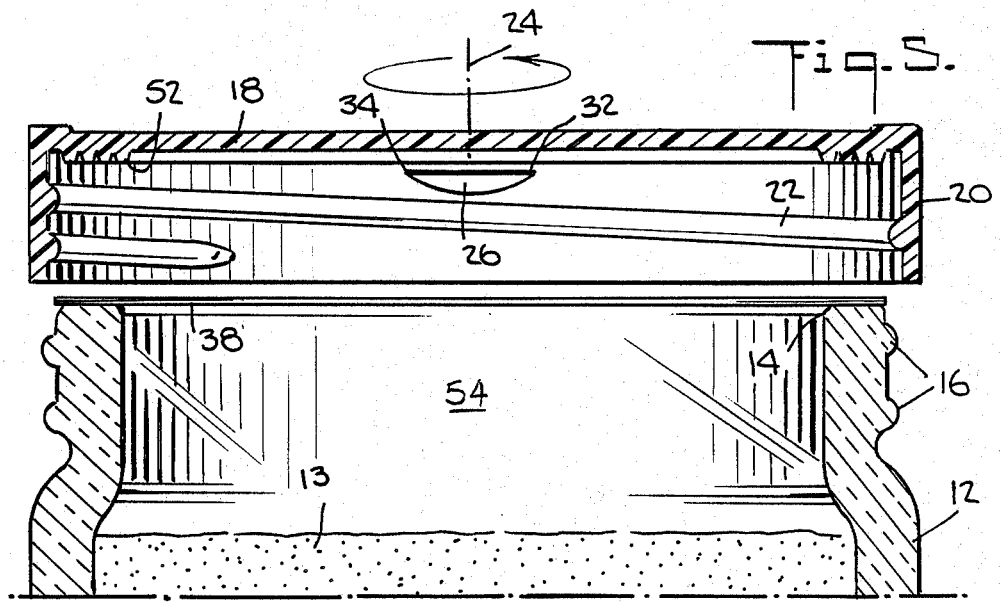
FIG. 5 is a view similar to FIG. 4, with the cover member removed.
Figure 6:
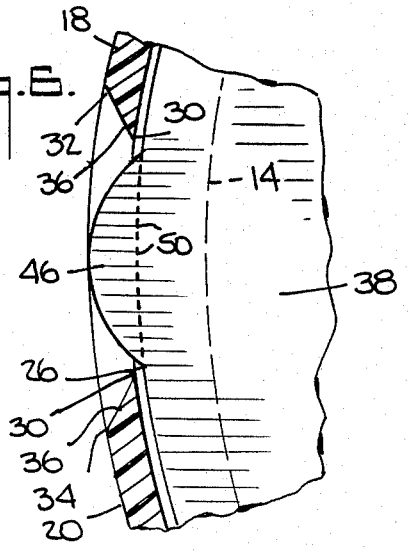
FIG. 6 is an enlarged fragmentary sectional view thereof.

Preferably the tab member 46 is bent in the manner shown in FIG. 4 to permit a recessed disposition in the slot 26. The tab member 46 is thus not susceptable to damage from normal handling or inadvertent contact with other objects. Perforations 50 (FIG. 6) or other suitable known lines of weakness can be provided where the tab member 46 joins the seal member 38.

The tab member 46 can be provided with suitable indicia (not shown) to identify the tab 46 or its function, such as the word "secure".

Figure 11:
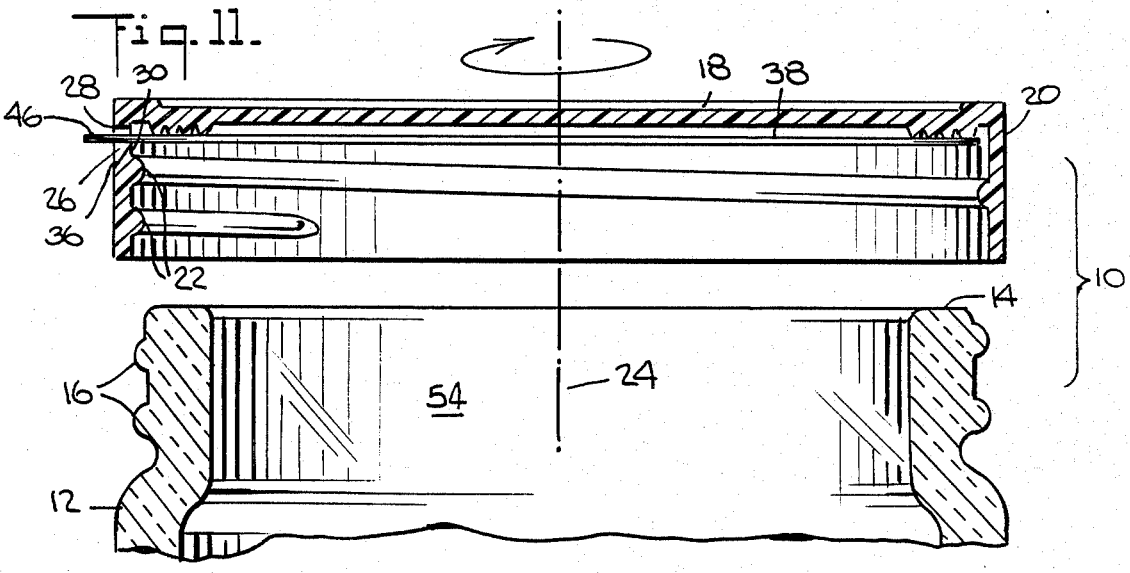
FIG. 11 is a fragmentary sectional view thereof prior to installation of the cover member on the receptacle; and, FIG. 12 is a fragmentary sectional view thereof during bonding of the seal member to the receptacle.

In assembling the package 10, the seal member 38 and the integrally joined tab indicating member 46 are positioned inside the cover member 18, such as shown in FIG. 11. It will be noted that the seal member 38 is oriented with the tab extension member 46 projecting from the slot 26. The tab indicating member 46 is preferably folded into a recessed position in the slot 26 as shown in FIG. 4.

The tab member 46 is formed in the same plane as the seal member 38. During positioning of the seal member 38 in the cover member 18, the tab 46 is extended in the slot 26 and if desired, bent to the recessed position. If desired, the tab 46 can be pre-bent in the form shown in FIG. 4, before being extended in the slot 26 of the cover member 18.

The cover member 18, with the seal member 38 disposed therein, is engaged with the threaded mouth portion 14 of the receptacle 12. The cover member 18 is turned in a clockwise direction to a predetermined closed limit position on the receptacle 18, wherein the seal member 38 no longer turns with the cover member 18. The induction sealer 44 is used in a suitable known manner to cause the heat sensitive layer 42 of the seal member 38 to bond or otherwise adhere to the mouth portion 14 of the receptacle 12. Bonding of the seal member 38 may be facilitated by provision of annular peripheral projections 52 on the inside surface of the cover member 18. The projections 52 bear against the seal member 38 in the area where the seal member 38 engages the mouth portion 14 of the receptacle 12.

Once the seal member 38 is thus secured to the mouth portion 14 of the receptacle 12, movement of the cover member 18 will not cause movement of the seal member 38.

It should be noted that the tab extension member 46 is sized to have a predetermined minimal clearance with the slot 26. Thus, when the cover member 18 is moved a predetermined minimum amount from the closed limit position, in a counter-clockwise direction toward an open position, there will be interference between the lower edge 30 of the slot 26 and the tab extension member 46. The lower edge 30 of the slot 26 functions as a severing edge which rips or severs the tab extension member 46 as the slot 26 moves past the tab extension member 46.

Figure 2:
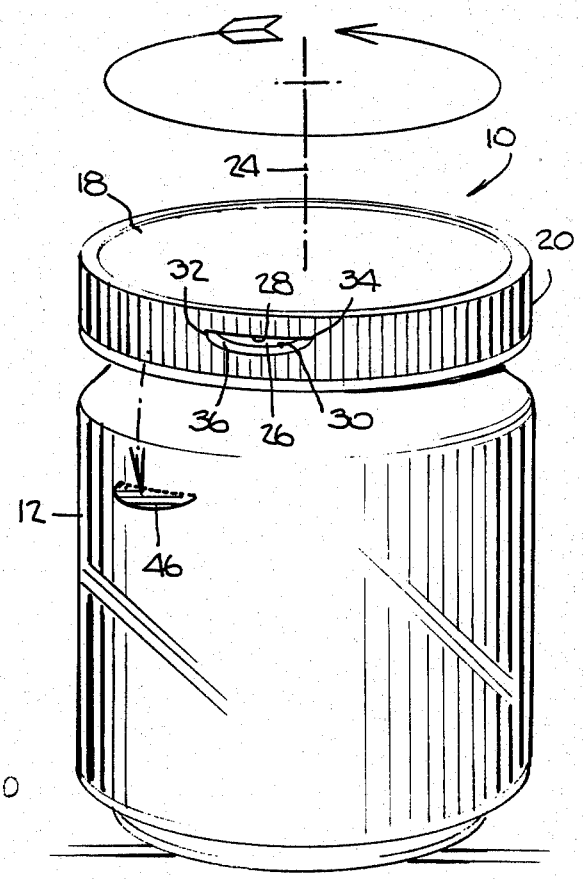
FIG. 2 is a view similar to FIG. 1 with a tamper indicating tab severed from the package.
Figure 3:
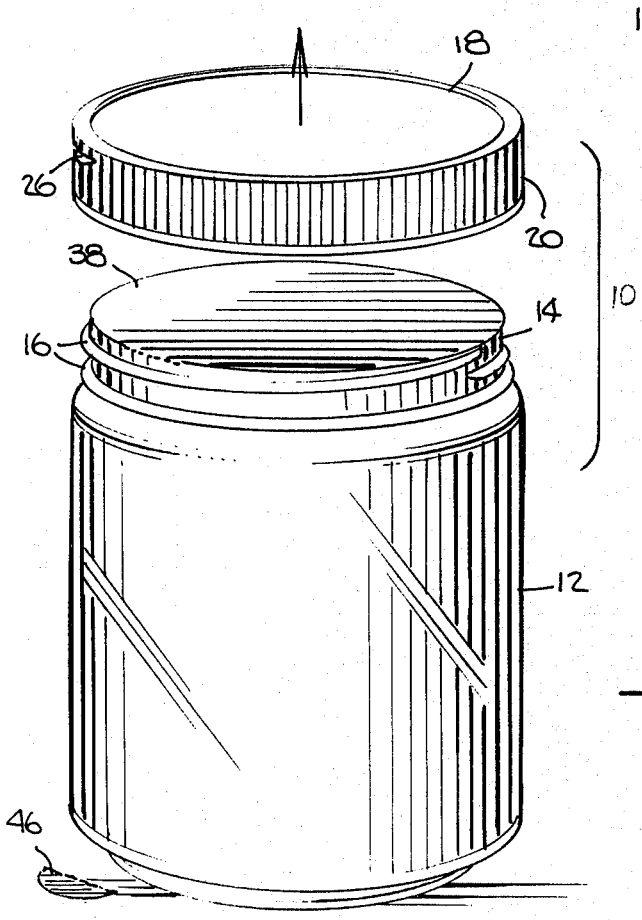
FIG. 3 is a partially exploded view thereof.
Figure 7:
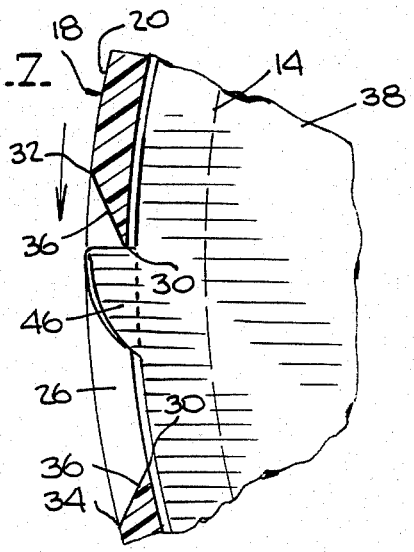
FIG. 7 is a view similar to FIG. 6 showing the tamper indicating tab being severed by the cover member.

Consequently, whether or not the cover member 18 is completely removed from the receptacle 12, a predetermined counter-clockwise rotation of such cover member 18 on the receptacle will partially or completely rip or sever the tab extension member 46 from the seal member 38 in the manner shown in FIG. 2. The tab extension member 46 is thus free to drop away from the seal member 38. If the cover member 18 is not turned sufficiently to cause the slot 26 to move entirely past the tab extension member 46, the tab 46 will curl up, distort or otherwise exhibit the effects of partial severance, as shown in FIG. 7.

In either situation, i.e., whether the tab extension member 46 is partially severed or entirely severed from the seal member 38, the condition of the tab 46 in the slot 26 is immediately evident to the consumer. Thus a simple check of the slot 26 will show the consumer whether the integrity of the package 10 is questionable.

Some advantages of the present invention evident from the foregoing description include a tamper indicating package that is easy to construct and assemble, and provides a readily visible external indication of whether the package has been opened. A further advantage is that the tamper indicating package incorporates a tamper indicating tab with a seal member and thus permits a relatively simple and inexpensive manufacturing operation.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. A tamper indicating package comprising, (a) a receptacle having an interior space and a mouth portion, (b) a detachable cover member for covering the mouth portion of said receptacle, said cover member being disposable in a predetermined closed limit position on said receptacle, said cover member having an opening therein, and being movable toward an open position, (c) a seal member secured to said mouth portion for sealing said interior space, (d) indicating means joined to said seal member and projecting through the opening in said cover member when said cover member has remained substantially immobile in said predetermined closed limit position and, (e) said indicating means being formed of a frangible material for severance from said seal member by said cover member upon movement of said cover member a predetermined amount toward said open position from said predetermined closed limit position.

2. The package as claimed in claim 1 wherein said cover member includes a peripheral depending flange, and said opening comprises a slot formed in said flange.

3. The package as claimed in claim 1 wherein said receptacle has a longitudinal axis and said cover member is substantially perpendicular to said longitudinal axis when said cover member is in said predetermined closed limit position, said flange being generally parallel to said longitudinal axis, said indicating means having a first predetermined radial extent with respect to said longitudinal axis and said slot having a second predetermined radial extent of slightly greater magnitude than said first predetermined radial extent to accommodate said indicating means when said slot is aligned with said indicating means.

4. The package as claimed in claim 3 wherein said indicating means is generally unbroken and unripped when said cover member is immobile in said predetermined closed limit position, said cover member being movable with respect to said indicating means from said predetermined closed limit position to said open position, and said slot is sized to interfere with said indicating means when said cover member is moved from said predetermined closed limit position towards said open position to change the generally unripped and unbroken condition of said indicating means to a ripped and broken condition.

5. The package as claimed in claim 1 wherein said indicating means is formed of a material that severs from said seal member when said cover member is moved a predetermined amount from said predetermined closed limit position.

6. The package as claimed in claim 1 wherein said cover member includes at least one severing edge at one side of said slot to sever said indicating means upon movement of said cover member from said predetermined closed limit position to said open position.

7. The package as claimed in claim 1 wherein said indicating means has a predetermined line of weakness to facilitate severance of said indicating means from said seal member.

8. The package as claimed in claim 2 wherein said indicating means comprises a tab extension member joined to said seal member.

9. The package as claimed in claim 8 wherein said tab extension member is recessed in said slot.

10. The package as claimed in claim 8 wherein said seal member is formed of a material selected from the group consisting of cellulose derivatives, plastic, aluminum foil and combinations thereof.

11. The package as claimed in claim 1 wherein said indicating means comprises a tab extension of said seal member.

12. The package as claimed in claim 1 wherein said receptacle comprises a container threaded at said mouth portion and said cover member comprises a threaded cover engageable with the threaded mouth portion.

13. A tamper indicating package comprising, (a) a jar having a threaded mouth portion, (b) a cover threadably engageable with the mouth portion of the jar to cover the mouth portion and being threadable in one direction to a predetermined closed limit position on said jar, threaded movement of said cover member in a second direction opposite said one direction tending to open said cover member, (c) a seal member bonded to said mouth to seal said mouth portion, (d) said cover member having a slot formed therein, (e) said seal member having an extension tab projecting through said slot so as to be visually apparent from the outside of said cover member when said cover member is in said closed position, and (f) said extension tab and said slot being of selected predetermined sizes such that movement of said cover member from said predetermined closed position toward said open position tends to rip and sever said tab from said seal member.

14. The package a claimed in claim 13 wherein movement of said cover member a predetermined amount from said closed position toward said open position causes said cover member to completely sever said tab from said seal member.

15. The package as claimed in claim 14 wherein movement of said cover member toward said open position less than said predetermined amount to a predetermined intermediate position causes said cover member to partially sever said tab.

16. The package as claimed in claim 13 wherein said tab is recessed in said slot.

17. The package as claimed in claim 13 wherein said tab has a predetermined radial arc of weakness to facilitate severance of said tab from said seal member.

18. A method of indicating that a package has been tampered with comprising, (a) forming a slot in a cover member that covers a receptacle of the package, (b) bonding a sealing member across a mouth portion of the receptacle beneath the cover member, (c) joining an indicating tab to the seal member such that the tab extends through the slot in the cover member when the cover member is in a predetermined closed limit position on the receptacle, (d) sizing the slot with a predetermined clearance relative to the tab such that movement of the cover member from the closed position toward an open position causes the slot to interfere with the tab member and rip and sever the tab member from the seal member, whereby the condition of the tab is visually apparent in the slot and the absence or partially severed condition of the tab serves to indicate that the package has been tampered with, whereas the intact condition of the tab in the slot serves to indicate that the package has not been tampered with.

19. The method as claimed in claim 18 wherein the tab is formed as an integral extension of the seal member.

20. The method as claimed in claim 19 including providing a line of weakness along the tab to facilitate severance of the tab from the cover member when the cover member is moved from the closed position toward the open position.

21. A tamper indicating package comprising, (a) a receptacle with a rim and a seal member secured to said rim, (b) a detachable cover member for covering said receptacle, said cover member being disposable in a first closed position on said receptacle, said cover member having an opening therein, and being movable away from said first closed position, (c) indicating means jointed to said seal member of said receptacle, and projecting through the opening in said cover member when said cover member has remained substantially immobile in said first closed position, and (d) said indicating means being formed of a frangible material for severance from said receptacle by said cover member upon movement of said cover member a predetermined amount away from said first closed position.

22. The tamper indicating package as claimed in claim 21 wherein said indicating means comprises a tab extension member joined to said seal member.

* * * * *